US012663006B2

(12) United States Patent
Sasaki et al.

(10) Patent No.: US 12,663,006 B2
(45) Date of Patent: Jun. 23, 2026

(54) PUMP OR FLUID-POWERED MOTOR CONNECTION

(71) Applicant: Caterpillar Inc., Peoria, IL (US)

(72) Inventors: Kazuma Sasaki, Akashi (JP); Naoki Sawada, Kako-Gun (JP); Stive Ramalho, Isle d'Abeau (FR)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/897,737

(22) Filed: Sep. 26, 2024

(65) Prior Publication Data

US 2026/0085685 A1 Mar. 26, 2026

(51) Int. Cl.
*F04B 53/22* (2006.01)
*F04B 1/2064* (2020.01)

(52) U.S. Cl.
CPC ..... *F04B 53/22* (2013.01); *F04B 1/2064* (2013.01)

(58) Field of Classification Search
CPC ..... F15B 15/08; F04D 25/04; F04C 15/0042; F04B 53/16; F04B 1/145; F04B 1/2064; F04B 53/22; F16B 2200/99; Y10T 403/1616; Y10T 403/1624
USPC ..... 417/405; 403/13, 14
See application file for complete search history.

(56) References Cited

U.S. PATENT DOCUMENTS 2,439,241 A 4/1948 Curtis et al.
2,965,040 A * 12/1960 Eisenberg ..... F04C 15/0026 418/152
3,186,352 A * 6/1965 Anderson ..... F01B 3/0032 91/487
3,407,742 A * 10/1968 Mitchell ..... F01C 21/0809 418/268

(Continued)

FOREIGN PATENT DOCUMENTS

CN 202597963 U 12/2012
CN 203430675 U 2/2014

(Continued)

OTHER PUBLICATIONS

"U.S. Appl. No. 17/393,685, Non Final Office Action mailed Mar. 15, 2023", 34 pgs.

(Continued)

*Primary Examiner* — Mark A Laurenzi
*Assistant Examiner* — Benjamin Doyle
(74) *Attorney, Agent, or Firm* — Schwegman Lundberg & Woessner, P.A.

(57) ABSTRACT

A pump or fluid-powered motor and a flange may include a pump housing defining an inlet and an outlet and internal pump components arranged within the housing and operably coupled to a drive shaft extending out of an end of the housing and defining a longitudinal axis. A pump flange may be arranged on the end of the housing and comprising a generally rectangular plate having a plurality of bolt holes. The pump flange may also include a pilot projection defining (Continued)

a pilot diameter, a torque pin feature, and a through bore with the drive shaft extending therethrough. The plurality of bolt holes may define a rectangular pattern with an X-spacing a Y-spacing. The torque pin feature may be arranged a distance from the longitudinal axis and on the Y-axis, wherein a ratio of the distance to the pilot diameter ranges from approximately 0.50 to approximately 0.70.

20 Claims, 6 Drawing Sheets

(56) References Cited

U.S. PATENT DOCUMENTS

| | | | | |
|---|---|---|---|---|
| 3,465,616 | A * | 9/1969 | Schou | F16H 47/04 60/426 |
| 3,499,388 | A * | 3/1970 | Eberhardt | F04D 7/04 415/196 |
| 3,550,727 | A * | 12/1970 | Mccain | F04D 13/022 192/223.1 |
| 3,787,014 | A * | 1/1974 | Story | H02K 5/00 310/91 |
| 3,817,665 | A * | 6/1974 | Myers | F04C 2/088 418/189 |
| 4,023,836 | A | 5/1977 | Applehans | |
| 4,225,186 | A | 9/1980 | Stratton | |
| 4,362,413 | A * | 12/1982 | Heard | F16B 21/04 403/14 |
| 4,501,536 | A * | 2/1985 | Middlekauff | F01C 20/08 418/61.3 |
| 4,586,885 | A * | 5/1986 | Middlekauff | F04C 2/103 418/61.3 |
| 4,601,378 | A * | 7/1986 | Pierce | F16D 27/00 192/115 |
| 4,872,813 | A * | 10/1989 | Gorton | A61M 5/14216 417/63 |
| 5,018,397 | A * | 5/1991 | Matich | G01D 5/00 73/866.5 |
| 5,203,681 | A * | 4/1993 | Cooper | F04D 7/065 417/372 |
| 5,423,183 | A * | 6/1995 | Folsom | F16H 39/10 60/413 |
| 5,645,343 | A | 7/1997 | Rinehimer | |
| 5,645,363 | A | 7/1997 | Dafforn et al. | |
| 5,847,471 | A * | 12/1998 | Morishita | F02N 15/00 290/38 A |
| 6,158,302 | A * | 12/2000 | Becker | F16H 57/025 74/606 R |
| 6,345,968 | B1 | 2/2002 | Shupe | |
| 6,398,521 | B1 * | 6/2002 | Yorulmazoglu | F04D 29/044 417/423.6 |
| 6,406,271 | B1 * | 6/2002 | Valentin | F04B 1/126 91/499 |
| 6,481,388 | B1 | 11/2002 | Yamamoto | |
| 6,526,748 | B1 | 3/2003 | Trimble | |
| 6,688,858 | B1 * | 2/2004 | Boone | F04B 1/2064 417/269 |
| 6,742,816 | B2 | 6/2004 | Rocheleau | |
| 6,896,491 | B2 | 5/2005 | Trubnikov et al. | |
| 7,635,255 | B2 | 12/2009 | Gleasman et al. | |
| 7,695,252 | B2 | 4/2010 | Sakikawa | |
| 9,698,649 | B2 * | 7/2017 | Cemke | H02K 5/26 |
| 10,145,396 | B2 | 12/2018 | Du et al. | |
| 11,168,772 | B2 * | 11/2021 | Mathers | F16H 39/04 |
| 11,255,193 | B2 * | 2/2022 | Mathers | F04C 15/0088 |
| 2004/0226617 | A1 | 11/2004 | Arentsen et al. | |
| 2009/0056123 | A1 | 3/2009 | Phillips et al. | |
| 2009/0280021 | A1 * | 11/2009 | Mathers | F01C 21/0863 418/184 |
| 2012/0034121 | A1 * | 2/2012 | Hicks | F03C 2/08 418/111 |
| 2012/0275928 | A1 | 11/2012 | Fritz et al. | |
| 2016/0039277 | A1 * | 2/2016 | Falls | H02K 7/116 310/58 |
| 2016/0084321 | A1 * | 3/2016 | Mihajlovic | F16D 25/0632 192/66.22 |
| 2017/0191499 | A1 * | 7/2017 | Chrabascz | F04D 29/526 |
| 2018/0162382 | A1 * | 6/2018 | Colavincenzo | B60K 6/442 |
| 2020/0070644 | A1 * | 3/2020 | Tigue | B62D 55/125 |
| 2021/0388825 | A1 * | 12/2021 | Watt | B60K 1/00 |
| 2022/0106951 | A1 * | 4/2022 | Foster | F04B 15/02 |
| 2022/0252083 | A1 | 8/2022 | Speichinger et al. | |
| 2023/0043842 | A1 | 2/2023 | Mickiewicz et al. | |
| 2025/0043684 | A1 * | 2/2025 | Zug | F01B 3/0047 |

FOREIGN PATENT DOCUMENTS

| | | | |
|---|---|---|---|
| CN | 106678011 | A | 5/2017 |
| CN | 107859635 | A | 3/2018 |
| CN | 104295479 | B | 7/2018 |
| CN | 208203654 | U | 12/2018 |
| CN | 211853102 | U | 11/2020 |
| CN | 112145450 | A | 12/2020 |
| CN | 213018226 | U | 4/2021 |
| CN | 214788321 | U | 11/2021 |
| EP | 2059674 | B1 | 8/2018 |
| EP | 3539876 | A1 | 9/2019 |
| GB | 673718 | A | 6/1952 |
| GB | 2101220 | A | 1/1983 |
| GB | 2506148 | A | 12/2019 |
| JP | 5015988 | B2 | 9/2012 |
| RU | 2101586 | C1 | 1/1998 |
| RU | 2505713 | C1 | 1/2014 |
| SU | 1048129 | A1 | 10/1983 |
| TW | M559939 | U | 5/2018 |
| WO | 2015074440 | A1 | 5/2015 |

OTHER PUBLICATIONS

"International Application Serial No. PCT US2022 038260, International Search Report mailed Oct. 28, 2022", 4 pgs.
"International Application Serial No. PCT US2022 038260, Written Opinion mailed Oct. 28, 2022", 6 pgs.
"U.S. Appl. No. 17/171,416, Non Final Office Action mailed Feb. 24, 2023", 25 pgs.
"U.S. Appl. No. 17/171,473, Non Final Office Action mailed Apr. 13, 2023", 23 pgs.
"Texas Flange Product Catalog: Ver 5.00", [Online] Retrieved from the internet: https: web.archive.org web 20200523222344 https: www.texasflange.com wp-content uploads 2019 06 catalog-c-v5. pdf, (May 23, 2020), 80 pgs.
"U.S. Appl. No. 17/171,416, Response filed May 23, 2023 to Non Final Office Action mailed Feb. 24, 2023", 10 pgs.
"U.S. Appl. No. 17 393,685, Response filed Jun. 15, 2023 to Non Final Office Action mailed Mar. 15, 2023", 14 pgs.
"U.S. Appl. No. 17/171,416, Final Office Action mailed Jun. 22, 2023", 29 pgs.
"Flange Faces", saVRee 3D Interactive Media, [Online]. Retrieved from the Internet: https : savree.com enencyclopedia flange-faceshttps : web.archive.org web 20201125173751, (Nov. 25, 2020), 4 pgs.
"U.S. Appl. No. 17/171,473, Response filed Jul. 12, 2023 to Non Final Office Action mailed Apr. 13, 2023", 16 pgs.
"U.S. Appl. No. 17/393,685, Final Office Action mailed Jul. 6, 2023", 37 pgs.
"U.S. Appl. No. 17/171,416, Response filed Aug. 22, 2023 to Final Office Action mailed Jun. 22, 2023", 11 pgs.
"U.S. Appl. No. 17/393,685, Response filed Sep. 6, 2023 to Final Office Action mailed Jul. 6, 2023", 12 pgs.
"U.S. Appl. No. 17/393,685, Advisory Action mailed Sep. 14, 2023", 3 pgs.
"U.S. Appl. No. 17/171,416, Advisory Action mailed Sep. 7, 2023", 4 pgs.
"U.S. Appl. No. 17/393,685, Response filed Oct. 4, 2023 to Advisory Action mailed Sep. 14, 2023", 13 pgs.

(56) References Cited

OTHER PUBLICATIONS

"U.S. Appl. No. 17/171,416, Response filed Oct. 20, 2023 to Advisory Action mailed Sep. 7, 2023", 13 pgs.
"U.S. Appl. No. 17/171,473, Final Office Action mailed Oct. 3, 2023", 23 pgs.
"International Application Serial No. PCT US2022 015187, International Search Report and Written Opinion mailed May 3, 2022", 8 pgs.
"International Application Serial No. PCT US2022 015165, International Search Report and Written Opinion mailed May 31, 2022", 11 pgs.
"U.S. Appl. No. 17/171,416, Notice of Allowance mailed Dec. 5, 2023", 14 pgs.
"U.S. Appl. No. 17/171,416, Corrected Notice of Allowability mailed Dec. 12, 2023", 11 pgs.
"U.S. Appl. No. 17/171,416, Corrected Notice of Allowability mailed Feb. 9, 2024", 12 pgs.
"Complete Hydraulic Solutions Product Guide", [retrieved from internet on Aug. 3, 2024] URL:https:rapidhydraulics.com .au pdf southcott-components-product-sept-2018.pdf, (published on Sep. 2018), 1 pg.
Casappa Polaris, "Hydraulic Gear Pumps and Motors", (May 4, 2023), 92 pgs.
Rexroth Bosch Group, "Axial Piston Variable Pump", The Drive Control Company, RE 92050, (Oct. 2018), 76 pgs.
SKF, "UCF 212-36 Square Flanged Ball Bearing Units", [Online]. Retrieved from the Internet: URL: www.skf.com, (May 7, 2021), 4 pgs.
U.S. Appl. No. 18/897,306 filed Sep. 26, 2024, Pump Mounting Flange.
U.S. Appl. No. 18/897,347 filed Sep. 26, 2024, Pump Mounting Flange.
U.S. Appl. No. 17/393,685, now U.S. Pat. No. 12,006,924, filed Aug. 4, 2021, Axial Piston Pump Mounting Flange Configuration.
U.S. Appl. No. 18/897,389 filed Sep. 26, 2024, Pump Mounting Flange.
U.S. Appl. No. 17/171,416, now U.S. Pat. No. 11,953,032, filed Feb. 9, 2021, Hydraulic Pump or Motor With Mounting Configuration for Increased Torque.
U.S. Appl. No. 17/171,473, filed Feb. 9, 2021, Hydraulic Pump or Motor With an Improved Mounting Configuration for Transferring Increased Torque.
U.S. Appl. No. 18/587,050 filed Feb. 26, 2024, , Hydraulic Pump or Motor With Mounting Configuration for Increased Torque.
U.S. Appl. No. 18/897,416, filed Sep. 26, 2024, Pump Mounting Flange.
U.S. Appl. No. 18/897,438, filed Sep. 26, 2024, Pump or Motor Mounting Flange.
Written Opinion and International Search Report for Int'l. Patent Appln. No. PCT/US2025/046103, mailed Jan. 16, 2026 (11 pgs).

* cited by examiner

PUMP OR FLUID-POWERED MOTOR CONNECTION

TECHNOLOGICAL FIELD

The present application relates generally to fluid management systems for work machines. More particularly, the present application relates to connections of pumps or fluid-powered motors within a fluid management system (e.g., hydraulic system) to motors, engines, or other power take-off equipment or devices.

BACKGROUND

Connections between pumps and motors may be subject to continual operational forces. For example, a motor or engine may include a rotating shaft that extends out of the motor/engine housing and into the pump to drive the pump. That is, the rotating shaft may pass through the connection and the pump may resist motion of the shaft creating a torque between the motor/engine and the pump. Moreover, the pump may be mounted to the motor/engine housing or other power take-off housing and, in some cases, may not be otherwise supported. Accordingly, the inertial or other forces from internal motions and pressures within the pump and between the pump and other equipment and/or any external forces acting on the pump from connections or other piping or systems may be imparted to the connection between the pump and the motor or other power take-off system. While a pump has been described, sometimes the fluid flow may be reversed and the motive force may be the flowing fluid flowing into a fluid-powered motor to drive the fluid-powered motor, which, in turn, may drive a drive shaft and provide rotational power to the device it is connected to. In either case (i.e., pump or fluid-powered motor), it remains that the connection between the pump/fluid-powered motor and the housing may resist the forces generated by or imparted on the pump/fluid-powered motor.

With increasing demands on power and ongoing limitations on the size and/or pressures to reduce the size of components within engine compartments, standard connection designs are often not suitable to withstand the torsional and other forces experienced by pump connections.

SUMMARY

In one or more examples, a pump or fluid-powered motor and a flange for securing the pump or fluid-powered motor to a mount location may include a pump housing defining an inlet and an outlet and internal pump components arranged within the housing and operably coupled to a drive shaft extending out of an end of the housing and defining a longitudinal axis. The pump or fluid-powered and flange may also include a pump flange arranged on the end of the housing and comprising a generally rectangular plate having a plurality of bolt holes. The pump flange may also include a pilot projection defining a pilot diameter, a torque pin feature, and a through bore with the drive shaft extending therethrough. The pump flange may be arranged in an X-Y plane orthogonal to the longitudinal axis and the plurality of bolt holes may define a rectangular pattern with an X-spacing a Y-spacing. The torque pin feature being arranged a distance from the longitudinal axis and on the Y-axis, wherein a ratio of the distance to the pilot diameter ranges from approximately 0.50 to approximately 0.70.

In one or more examples, a connection for a pump or fluid-powered motor may include a mount location defining an X-Y plane and comprising a plurality of threaded bores for receiving fasteners, a pilot recess or opening, a portion of a rotational power coupling defining a longitudinal axis, and a first torque pin feature. The plurality of threaded bores may be arranged in a first rectangular pattern with an X-spacing and a Y-spacing and the torque pin feature may be arranged a first distance from the longitudinal axis on the Y-axis, wherein a ratio of the first distance to the pilot diameter ranges from approximately 0.50 to approximately 0.70. The connection may also include a flange configured for securing to the mount location. The flange may include a generally rectangular plate having a plurality of bolt holes, a pilot projection defining a pilot diameter and configured for nested engagement with the pilot recess or opening, a second torque pin feature, and a through bore with a drive shaft extending therethrough. The plurality of bolt holes may be arranged in a second rectangular pattern corresponding with the first rectangular pattern, and the second torque pin feature may be arranged along the Y-axis a second distance corresponding to the first distance.

DETAILED DESCRIPTION

Figure 1:
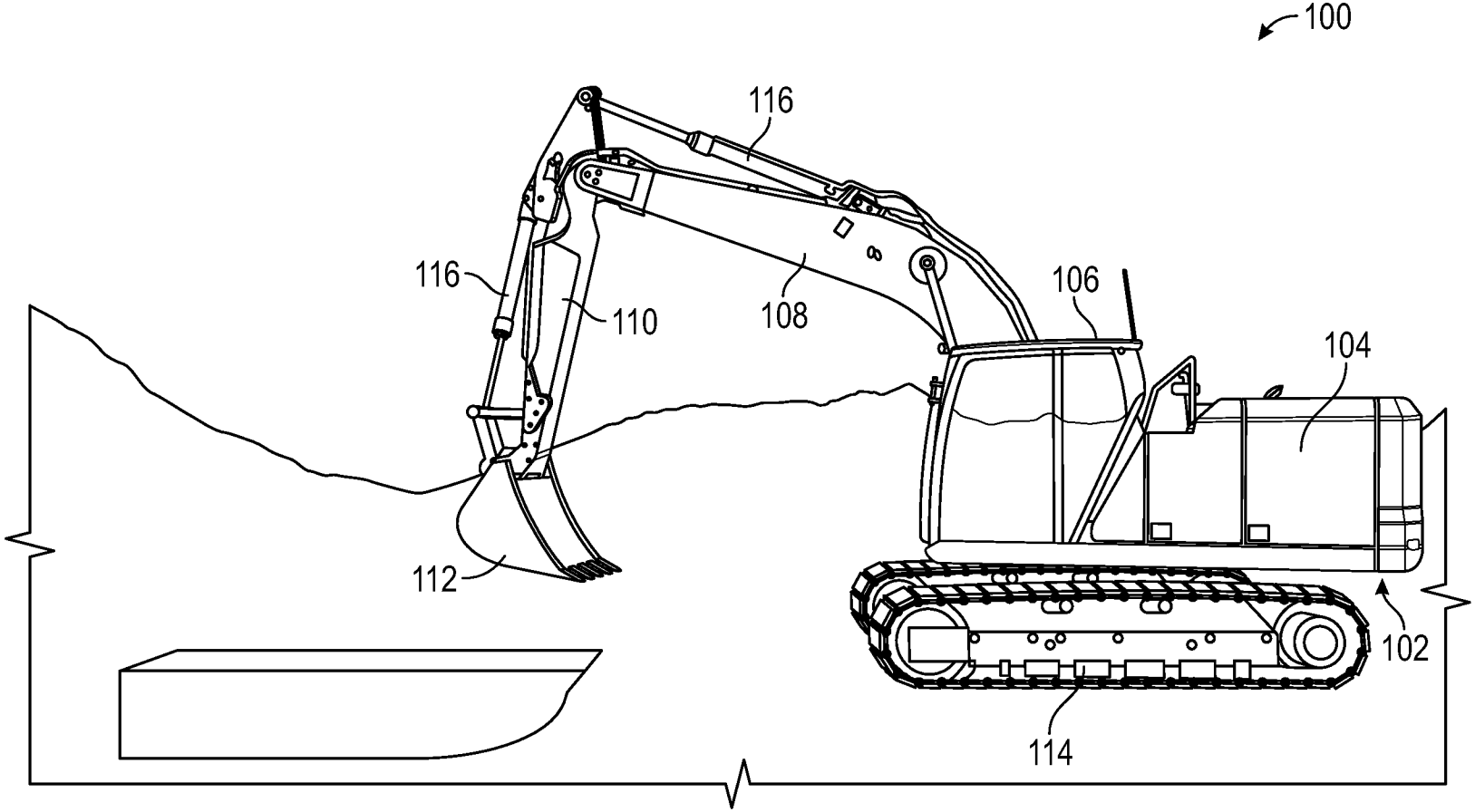
FIG. 1 is a perspective view of a work machine having a pump or fluid-powered motor with a mounting flange, according to one or more examples.

FIG. 1 is a perspective view of a work machine 100 in the form of an excavator. The work machine 100 may include a support frame including a rotating platform 102 and a prime mover 104 arranged on the platform 102 in addition to a cab or operator station 106. The work machine 100 may also include a primary boom 108 extending from the rotary platform, a secondary boom 110 extending from the primary boom 108, and a bucket 112 or other implement arranged on an end of the secondary boom 110. The work machine 100 may also include a ground engaging traction system such as a track system 114. Still other features of the work machine 100 may be provided and while an excavator has been provided as an example, still other types of work machines 100 with a pump/fluid-powered motor with a mounting flange according to the present application may be provided. For example, a work machine 100 may include a paver, crawler, front-end loader, compactor, rotary mixer, cold planer, haul truck, or another type of work machine 100.

The work machine 100 may include a hydraulic system operably coupled to the prime mover 104 to provide power to the hydraulic system and/or the hydraulic system may provide fluid flow to provide motor power to one or more aspects of the work machine 100. The presently described mounting flange may be provided to operably couple a pump/fluid-powered motor of the hydraulic system to a shaft or other power take-off or delivery point on a work machine 100. In one or more examples, the hydraulic system may be used to operate one or more implements on the work machine 100. For example, with the excavator shown, the hydraulic system may be used to drive, or retract, hydraulic cylinders 116 to pivot the primary and secondary booms 108/110 and/or the bucket 112 and to rotate the rotary platform 102. In the case of other work machines 100, other implements may be operated using a hydraulic system.

Figure 2:
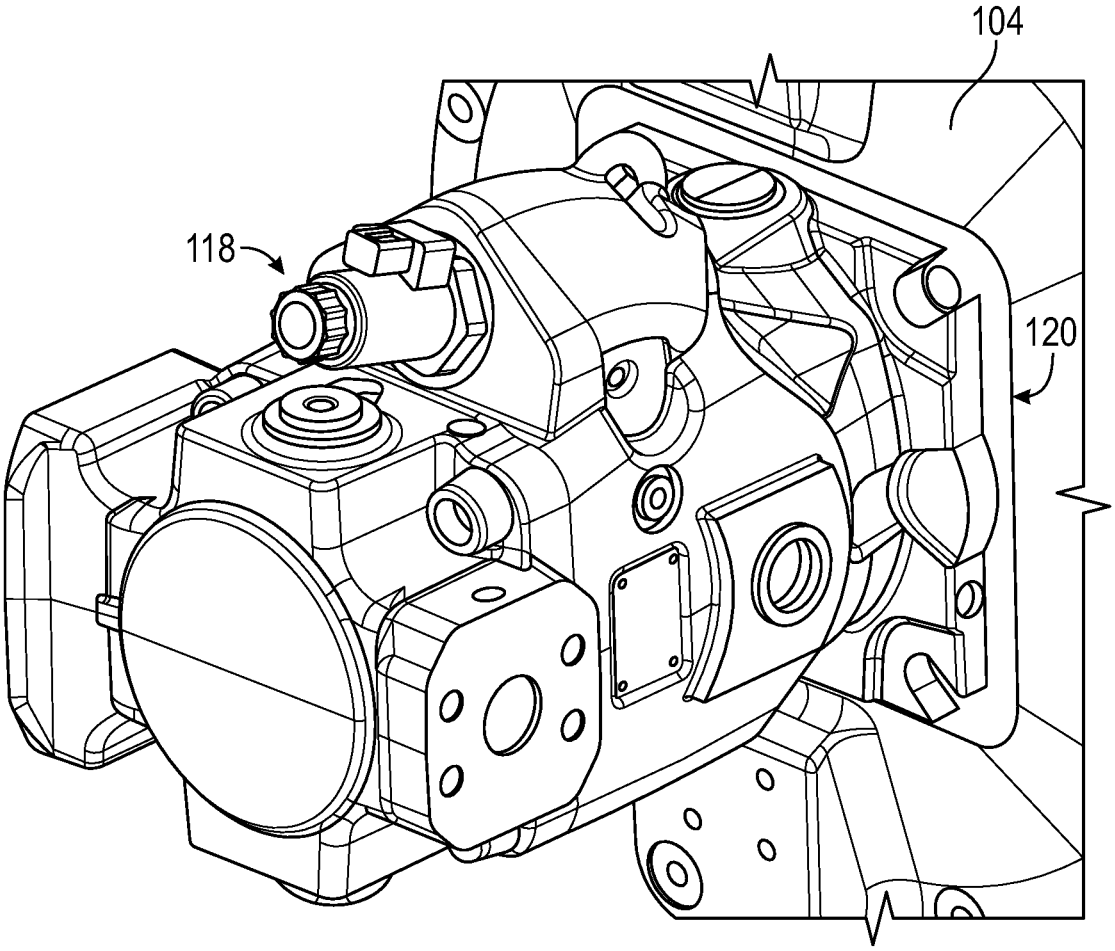
FIG. 2 is a perspective view of the pump or fluid-powered motor mounted to a mounting location, according to one or more examples.

Referring now to FIG. 2, one example of a connection between a hydraulic pump 118 and a prime mover 104 is shown. As shown, the prime mover 104 may include a power take-off location 120 where a pump 118 may be mounted and, as such, may be held in a position where the internal mechanisms of the pump 118 are mechanically coupled to mechanical mechanisms of the prime mover 104. In one or more examples, the prime mover 104 may include a power shaft with a socket at the power take-off location 120 and a spline shaft may extend from the pump 118 into the socket of the power take-off location 120. Alternatively, the opposite system may be provided where an exposed rotating and splined shaft extends from the power take-off location 120 of the prime mover 104 and a splined socket may be provided on the pump 118 such that the shaft of the prime mover 104 engages with the socket to transfer rotation from the shaft to the pump. Still other engagement mechanisms or rotational power couplings may be provided. In one or more examples, a seal or seals may be provided around the rotational power coupling to maintain pressurized lubrication within the pump and/or with the prime mover. Moreover, while a splined connection has been described, a keyway and key slot system, a through rod/pin, or other rotational power transfer mechanism may be provided.

It is to be appreciated that while a prime mover 104 with a power take-off location for mounting of the pump 118 has been described, the opposite situation may be provided as well. That, is the pump 118 may, instead, be a fluid-powered motor that receives flowing fluid that drives the fluid-powered motor and the fluid-powered motor may provide rotational power via a shaft to a connected device or system. For purpose of simplicity, a pump 118 will be referenced throughout, but it is to be understood that such pump 118 may also be a fluid-powered motor. Moreover, and for similar reasons, a power-take off location 120 will be referred to, more generally, hereafter as a mount location 120. However, it is to be understood that where a power take-off location 120 is referenced, this could just as well be a power receiving location or, more generally, a mount location 120.

Within the prime mover 104, rotational power may be provided to the socket or shaft of the mount location 120 in one or more ways. For example, the socket or shaft may include a direct drive where operation of the prime mover 104 causes rotation of the socket or shaft. This may be in the form of a geared connection to a primary output shaft of the prime mover 104 or a belt driven system may be provided. In other cases, a clutch or other selective engagement system may be provided allowing for selective operation of the power take-off, or power receiving, socket or shaft by selectively engaging the primary output shaft or belt/pully system thereof. In one or more examples, a transmission may be provided allowing for selective relative speeds and torques to be provided or received to/from the power take-off, or power receiving, socket or shaft. Still other approaches to providing power to, or receiving power from, the power take-off, or power receiving, socket, shaft, or other power transfer element of the mount location may be provided.

Figure 3:
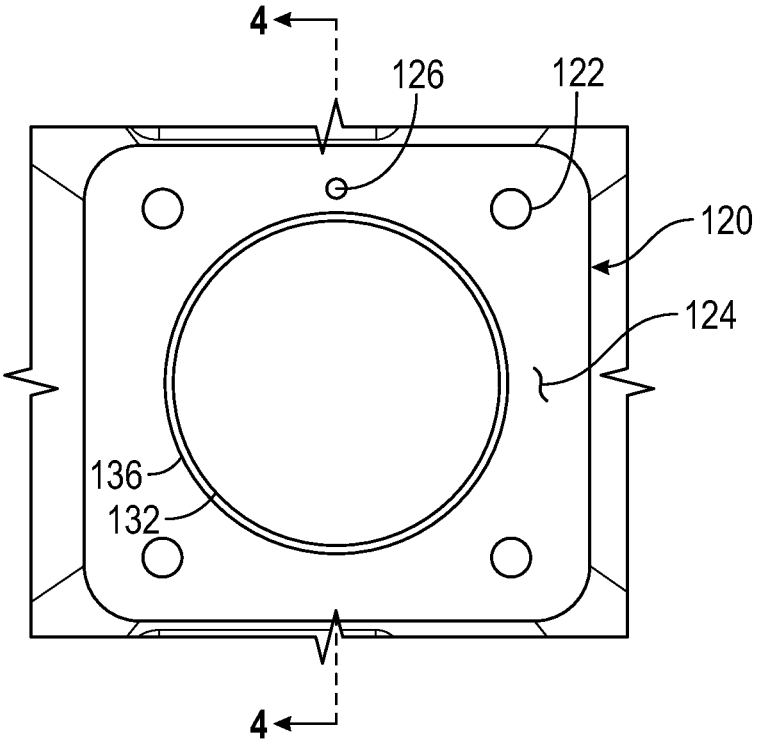
FIG. 3 is a front view of a mounting location, according to one or more examples.

Turning now to FIG. 3, one example of a mount location is shown. The mount location 120 may include one or more coupling features for securing the pump 118 to the mount location 120. The coupling features may be configured to interface with coupling features on the pump 118 to secure the pump to the mount location 120 of the prime mover 104 or other component. In one or more examples, and as shown in FIG. 3, the coupling features may include threaded bores 122 that extend into the housing 124 or other mounting feature of the prime mover 104 or other component. The bores 122 may be adapted to receive bolts that extend through a flange on the pump 118 and into the threaded bores 122 to secure the pump 118. Alternatively or additionally, the coupling feature may include threaded studs that extend outward from the mount location 120 and may be adapted to engage bolt holes on a flange of a pump where a nut or other fastener may be used to secure the flange to the threaded studs. The threaded bores, the threaded studs, or both, as the case may be, may be arranged in a pattern adapted to match a bolt hole pattern, or a portion thereof, on the flange of the pump 118.

Figure 6:
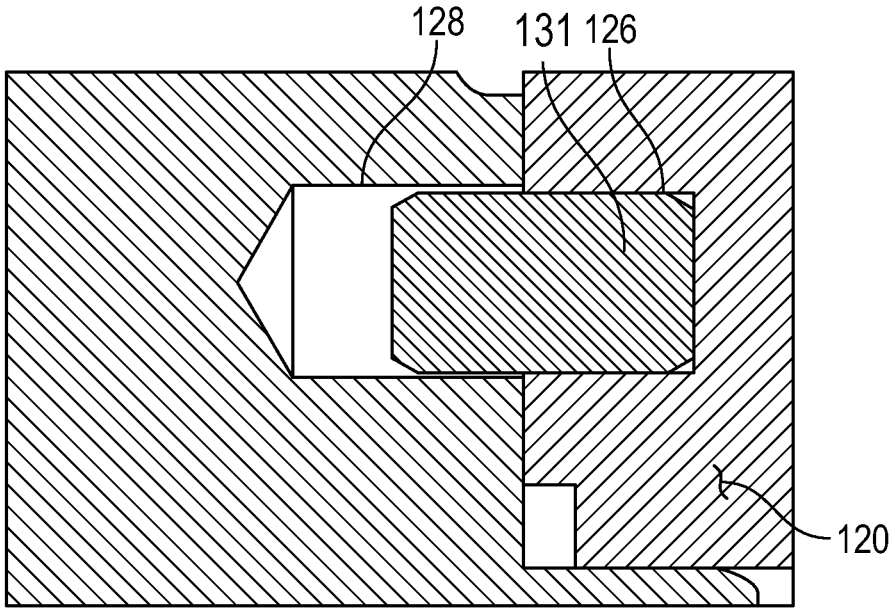
FIG. 6 is a cross-sectional view of a torque pin feature, according to one or more examples.

In one or more examples as shown in FIG. 3 and in cross-section in FIG. 6, a coupling feature in the form of a torque pin feature may be provided to increase the torque carrying capacity of the connection. That is, in contrast to bolts or threaded studs, the torque pin feature may include a blank or non-threaded pin or dowel 131 arranged in a hole 126 at the mount location 120 where the attachment flange of the pump 118 has a corresponding pin hole 128 and pin or a more permanent protruding pin. In one example, the pin hole 126 at the mounting location 120 may be adapted for generally permanently securing the pin 131 or securing the pin 131 ahead of mounting the pump 118 and may be sized for a friction fit or force fit. Alternatively, the pin hole 126 at the mounting location 120 may be adapted to receive the pin 131 during mounting of the pump 118 and, as such, may be sized for a slip fit as compared to a force fit. In still other examples, the pin 131 may protrude from the mounting location 120 and a pin hole 126 may not be provided. In still other examples, a portion of the pin 131 may be threaded to engage a threaded pin hole 126 at the mounting location 120 leaving an exposed portion of the pin 131 which is not threaded. In the case of a pin hole 126 sized for a friction fit or a force fit, a diameter of the pin hole 126 may range from approximately 6 mm to approximately 14 mm or from approximately 8 mm to approximately 12 mm, or a diameter of approximately 9.34 mm may be provided. The pin hole depth at the mounting location may range from approximately 7 mm to approximately 13 mm or from approximately 8 mm to approximately 10 mm or a depth of approximately 9 mm may be provided. The pin hole or pin at the mounting location 120 may be arranged in a position that corresponds to a pin hole or pin on the mounting flange, discussed in more detail below.

The coupling feature of the mount location 120 may also include a pilot recess or opening 132 configured to receive a pilot 134 of the pump flange to provide for alignment of the pump 118. The pilot of the pump flange is discussed in more detail below. The pilot recess or opening 132 at the mount location 120 may have a shape matching that of the pilot and slightly larger than the pilot so as to receive the pilot in nested fashion. In one or more examples, the pilot recess or opening 132 may be a circular recess or opening having a diameter slightly larger than the pilot on the pump flange. For example, the recess or opening diameter may range from approximately 144 mm to approximately 156 mm or from approximately 159 mm to approximately 151 mm or a diameter of 150.05 mm may be provided. In the case of a recess rather than an opening, the recess may have a depth adapted to fully receive the pilot (e.g., without the pilot bottoming out in the recess). That is, the recess depth may be slightly larger than the stub length of the pilot.

Figure 4:
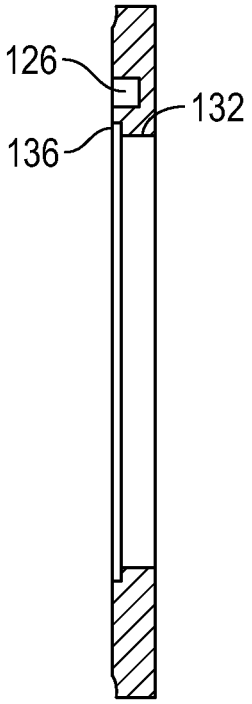
FIG. 4 is a cross-sectional view of the mounting location, according to one or more examples.

In addition to the pilot recess or opening 132, a seal recess 136 may also be provided at the mount location 120. That is, as shown in FIG. 4, the seal recess 136 may have a diameter larger than the pilot opening or recess 132 and may extend into the face of the mount location 120 with a depth selected to receive a portion of a face seal. In one more examples, the seal recess 136 may have a diameter ranging from approximately 150 mm to approximately 166 mm or from approximately 156 mm to approximately 160 mm, or a diameter of approximately 158.67 mm may be provided. The seal recess may have a depth ranging from approximately 1.5 mm to approximately 4.1 mm or from approximately 2.4 mm to approximately 3.2 mm, or a depth of approximately 2.84 mm may be provided.

A pump 118 may be secured to the mount location 120 and may be powered by the socket or shaft of the mount location 120. That is, as mentioned above, a powered and splined or keyed socket or shaft may be provided at the mount location 120, which may engage with a splined or keyed shaft or socket of the pump 118 to provide rotational power to the pump 118. The pump 118 may include an exterior housing 138 from which the shaft extends or in which a socket is arranged. The pump 118 may be designed to draw hydraulic fluid in through an inlet and expel hydraulic fluid out through an outlet for communication to implements of the machine such as hydraulic cylinders, hydraulic pumps, etc. Alternatively, and as mentioned, the pump 118 may be in the form of a fluid-powered motor that receives pressurized fluid through an inlet that drives the internal components of the pump and exits through an outlet. Driving of the internal components with the pressurized fluid may turn the drive shaft to deliver rotational power to the connected component rather than receive rotational power from the connected component.

In one or more examples, the pump 118 may be an axial piston pump. The piston pump may include internal components such as a plurality of cylinder/piston systems arranged within a barrel. The piston/cylinder systems may be operable in series by rotation of the barrel relative to a swash plate. That is, the drive shaft may be connected to the barrel and may cause the barrel to rotate. As the barrel rotates relative to the swash plate, the angle of the swash plate may cause the pistons to alternately retract and then extend to draw in fluid and then eject the fluid from the pump. The swash plate may have an adjustable angle to control the resulting volume of fluid flow from the pump 118. The axial piston pump may also operate in reverse where fluid flows into the pump to drive the piston and generate rotational power.

In other examples, the pump 118 may be a gear pump. For example, a gear pump may include internal components such as a pair of internal intermeshing gears arranged in a cavity that cooperate in their rotation to draw in fluid from one side and eject fluid out the other side or, in the case of a motor, receive fluid in one side and release fluid out the other side. The inlet/outlet ports may be arranged on opposing sides of the cavity to take in and eject fluid, respectively. In one or more examples, the gear pump/motor may include a drive gear supported and driven by the drive shaft that extends out of the housing. A follower gear may be supported on an idler shaft. In the case of a pump, the follower gear may receive power by meshing with the drive gear. In the case of a motor, both the drive gear and the follower gear may receive power from the flowing fluid and the drive gear may deliver the rotational power to drive the drive shaft. Each of the drive shaft and the idler shaft may be supported by bearings that allow for generally free rotation of the shafts and the gears arranged thereon.

It is to be understood that the internal components of the pump may vary from this detailed description and include other embodiments of rotational impeller type pumps, as well as other types of axial displacement pumps, gear pumps, etc. In any case, for purposes of securing the pump 118 to the mount location 120 and to manage the torsional and other forces between the pump 118 and the mount location 120, the pump 118 may include an attachment flange 140.

Figure 5:
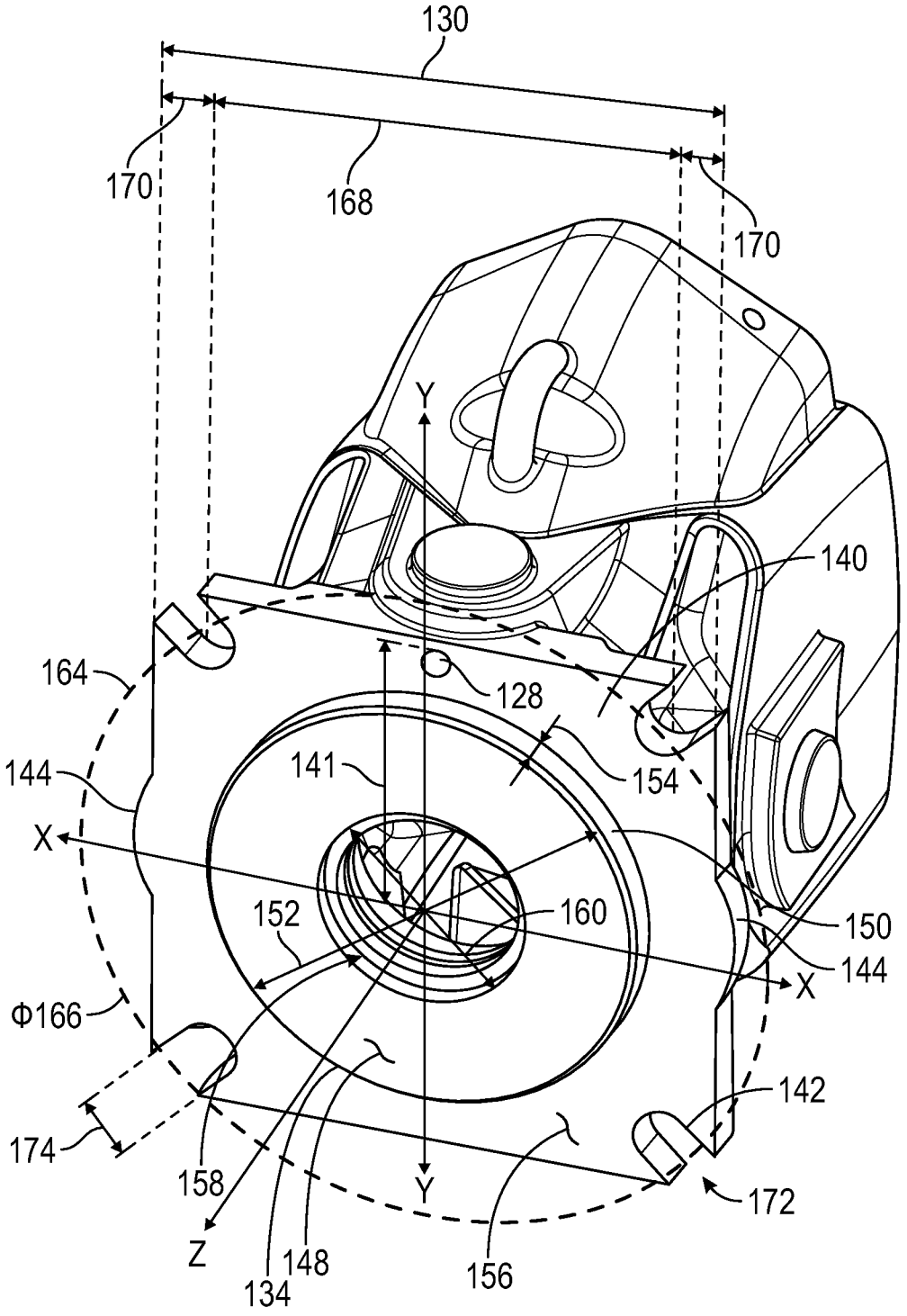
FIG. 5 is a perspective view of the pump or fluid-powered motor with a mounting flange, according to one or more examples.

As shown in FIG. 5, the attachment flange 140 of the pump 118 may be a generally rectangular or square flange having a width/length 130 ranging from approximately 180 mm to 220 mm or from approximately 194 mm to 206 mm or a width/length may be approximately 200 mm. As noted, the flange 140 may be rectangular or square and, as such, the width/length 130 might not be the same (e.g., rectangular) or the width/length 130 may be the same (e.g., square). As shown in FIG. 5, in one or more examples, the flange 140 may include bolt holes 142 for receiving fasteners to secure the flange 140 and pump 118 to the mount location 120. The bolt holes 142 in the flange may be diagonally slotted holes that extend through the corners of the flange 140. Alternatively or additionally, one or more of the bolt holes 142 may not be slotted. The corners on the flange at locations where the bolt hole is not slotted may be radiused corners having a radius ranging from approximately 15 mm to 25 mm or from approximately 18 mm to 20 mm or a radius of 19 mm may be provided. The flange 140 may have a thickness ranging from approximately 8 mm to 40 mm or from approximately 16 mm to 32 mm, or a thickness of approximately 24 mm may be provided.

In one or more examples, while the flange may be generally rectangular or square, a pair of curved surfaces 144 may extend from respective opposite sides of the flange 140. The chord length of the curved surfaces may extend approximately ⅛ to ⅜ of the length of the side of the flange 140 or approximately 3/16 to 5/16 of the length of the side of the flange 140 or a chord length of ¼ of the length of the side of the flange 140 may be provided.

As mentioned, the flange 140 may include a pilot 134 for engaging a pilot recess or opening 132 at the mount location 120. As shown in FIG. 5, the pilot 134 may include a raised element on the surface of the flange 140 adapted for arrangement in the pilot recess or opening 132 of the mount location 120. The pilot 134 may have a generally cylindrical shape having a circular end face 148 and a cylindrical sidewall 150 defined by a pilot diameter 152 and a stub length 154 extending away from a face 156 of the flange 140. The diameter 152 of the pilot 134 may range from approximately 145 mm to approximately 155 mm, or from approximately 148 mm to approximately 152 mm or the pilot 134 may have a diameter 152 of approximately 150 mm. The stub length 154 may range from approximately 10 mm to approximately 15 mm or from approximately 12 mm to approximately 13 mm or a stub length of approximately 12.5 mm may be provided. The intersection between the cylindrical sidewall 150 and the end face 148 of the pilot 134 may be chamfered. While described as cylindrical, alternatively, the pilot 134 may be rectangular, square, triangular, star-shaped, cross-shaped, or another shape may be provided.

As shown in FIG. 5, the flange 140 may include a through bore 158 arranged within the boundary of the pilot 134 to allow the shaft of the pump 118 to extend out of the pump for engagement with the socket at the mount location 120 or to allow a shaft of the mount location 120 to extend into the pump 118 to engage a socket. The through bore 158 may have a diameter 160 ranging from approximately 50 mm to 70 mm or approximately 55 mm to 65 mm or a diameter of approximately 60 mm may be provided. A chamfered or notched transition may be provided along the peripheral edge of the through bore 158 to transition from circular face 148 of the pilot 134 to the through bore 158.

In one or more examples, and as shown in FIG. 5, the flange 140 may define an X-Y-Z coordinate system where the Z-axis extends along a centerline of the power providing or receiving shaft. The X-axis may extend laterally across the face of the flange and the Y-axis may extend up/down across the face of the flange. All axes may pass through an origin arranged in the plane of the face 156 of the flange along the Z-axis.

As mentioned, the flange 140 may include a plurality of bolt holes 142 for securing the pump 118 to the mount location 120. The bolt holes 142 may be arranged to align with one or more portions of the coupling feature of the mount location 120. That is, for example, where threaded bores or threaded studs are provided at the mount location 120, the flange 142 may include one or more bolt holes 142 that align with these aspects of the coupling feature. In one or more examples, the plurality of bolt holes 142 may be arranged on a bolt circle 164 having a diameter 166 ranging from approximately 215 mm to 245 mm or from approximately 225 mm to 235 mm, or a bolt circle diameter 166 of 228.54 mm may be provided. It is to be appreciated that with respect to the torsional forces of the pump 118, the arrangement of the several bolt holes 142 on a same bolt circle 164 may cause all of the bolts arranged in the bolt holes 142 to experience a generally equally divided amount of load from the torsional force. That is, where 4 bolts are provided, each bolt may experience ¼ of the torsional load. Loads that vary from this equally divided condition may also be carried by the bolts.

As shown, the bolt holes 142 for receiving bolts to secure the pump 118 may be arranged in a rectangular or square pattern. In one example, the rectangular or square bolt pattern may include a 4-bolt pattern. These bolt holes 142 may be configured for securing a pump 118 to a mount location 120 with a corresponding pattern of threaded bores. That is, the flange bolt hole positions may correspond with the bore positions at the mount location 120. It is noted that, while not shown, the mount location 120 may include an additional pair of bores where each one of the pair of bores is arranged on either side of the Y-axis and on the X-axis. This pair of bores may be configured for receiving a pump secured to the mount location 120 with a corresponding 2-bolt flange. In other examples, a 6-bolt flange may be provided with bolts holes corresponding to all of the bores in the mounting location 120. With respect to the 4-bolt flange 140 and the corresponding 4 bores on the mount location 120, these may be arranged in a rectangular or square pattern. In one or more examples, the pattern may be a square pattern where the bolt spacing 168 from one bolt hole 142 to an adjacent bolt hole 142 ranges from approximately 150 mm to 170 mm or from approximately 155 mm to 165 mm or a spacing of approximately 161.6 mm may be provided.

The bolt holes 142 may have a diameter or width adapted to receive a bolt sufficiently large to carry the torsional and other loading. In one or more examples, the bolt holes 142 may have a diameter adapted for receiving an M20 bolt. The bolt holes 142 may be spaced inward from an outer edge of the flange by an edge distance 170 of approximately 19 mm. In one or more examples, for purposes of installation, the bolt hole 142 may extend through an outer edge of the flange 140. That is, for example, as shown in FIG. 5, a slot 172 may extend from the bolt hole 142 through the edge of the flange 140. In one or more examples, the bolt holes 142 may be arranged generally in the corners of the flange 140 and the slot 172 may be arranged diagonally to extend from the bolt hole 142 through the corner of the flange 140. The slot 172 may have a width 174 that is the same as the bolt hole diameter. In one or more examples, the bolt hole diameter and/or slot width may range from approximately 18 mm to approximately 26 mm or from approximately 20 mm to approximately 24 mm or a bolt hole diameter and/or slot width of approximately 22 mm may be provided. While slots extending diagonally through the corners of the flange have been described, horizontal or vertical slots may also be provided.

The pump 118 may be mounted to the mount location 120 with bolts, studs, or other fasteners. In one or more examples, a bolt size of M20 may be provided. Still other bolt sizes may be provided.

As mentioned with respect to the mount location 120, the flange 140 may also include a torque pin feature such as a torque pin or hole for receiving the torque pin. As shown in FIG. 5 and in cross-section in FIG. 6, the torque pin may be a blank or non-threaded pin or dowel arranged in a hole 128 on the flange in a position corresponding with the location of the pin hole at the mount location 120. In one or more examples, the flange 140 may be adapted to receive the pin during mounting of the pump and, as such, the pin hole 128 may be sized for a slip fit as compared to a force fit. Alternatively, the pin hole on the mounting flange 140 may be adapted for more permanently securing the pin or securing the pin ahead of mounting the pump 118 and may be sized for a friction fit or force fit. In still other examples, the pin may protrude from the flange 140 and a pin hole may not be provided. In still other examples, a portion of the pin may be threaded to engage a threaded pin hole on the flange 140 leaving an exposed portion of the pin which is not threaded. In the case of a pin hole sized for a slip fit, a diameter of the pin hole may range from approximately 6 mm to approximately 14 mm or from approximately 8 mm to approximately 12 mm, or a diameter of approximately 10 mm may be provided. The pin hole depth on the mounting flange may range from approximately 6 mm to approximately 14 mm or from approximately 11 mm to approximately 13 mm or a depth of approximately 12 mm may be provided.

The torque pin feature on the mounting flange 140 may be arranged outside a rectangular or square boundary defined by the one or more bolt holes 142 arranged on the flange 140. For example, as shown in FIG. 5, the pin hole or pin may be arranged on the Y-axis and may be spaced from the X-axis a distance 141 greater than the upper set of bolt holes. In one or more examples, the pin hole or pin may be arranged on the Y-axis and the distance 141 from the X-axis may range from approximately 80 mm to 100 mm, or from approximately 85 mm to approximately 95 mm, or a distance of approximately 90 mm may be provided. In some examples, the pin hole or pin may be arranged on the bolt circle defined by the 4-bolt, 2-bolt, or 6-bolt pattern defined by the bores or bolt holes 142 in the mounting location 120 and/or the pump flange 140, respectively. Moreover, while the pin hole or pin has been shown to be above the X-axis, a pin hole or pin may, instead, be provided below the X-axis. The pin hole or pin may also be arranged within the rectangular or square boundary rather than outside the rectangular or square boundary. It is to be appreciated that when the pin hole or pin is arranged within the boundary, care may be taken to avoid interference with the face seal surrounding the pilot area. Still further, while the pin hole or pin has been shown to be arranged on the Y-axis, the pin hole or pin may be arranged on the X-axis or it may be arranged off of the axes. While a single pin hole or pin has been shown or described, multiple pin holes or pins may be provided such as 2, 3, 4, 5, 6, 7, 8, or more pin holes or pins. In some examples, a combination of pin holes and pins may be provided on the flange 140 with corresponding pins and pin holes being provided at the mounting location 120. Still other approaches to locating the pin hole or pin may be provided.

Figure 7:
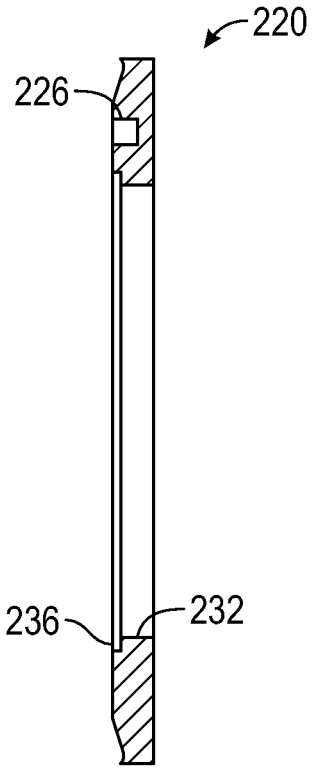
FIG. 7 is a cross-sectional view of another mounting location, according to one or more examples.
Figure 8:
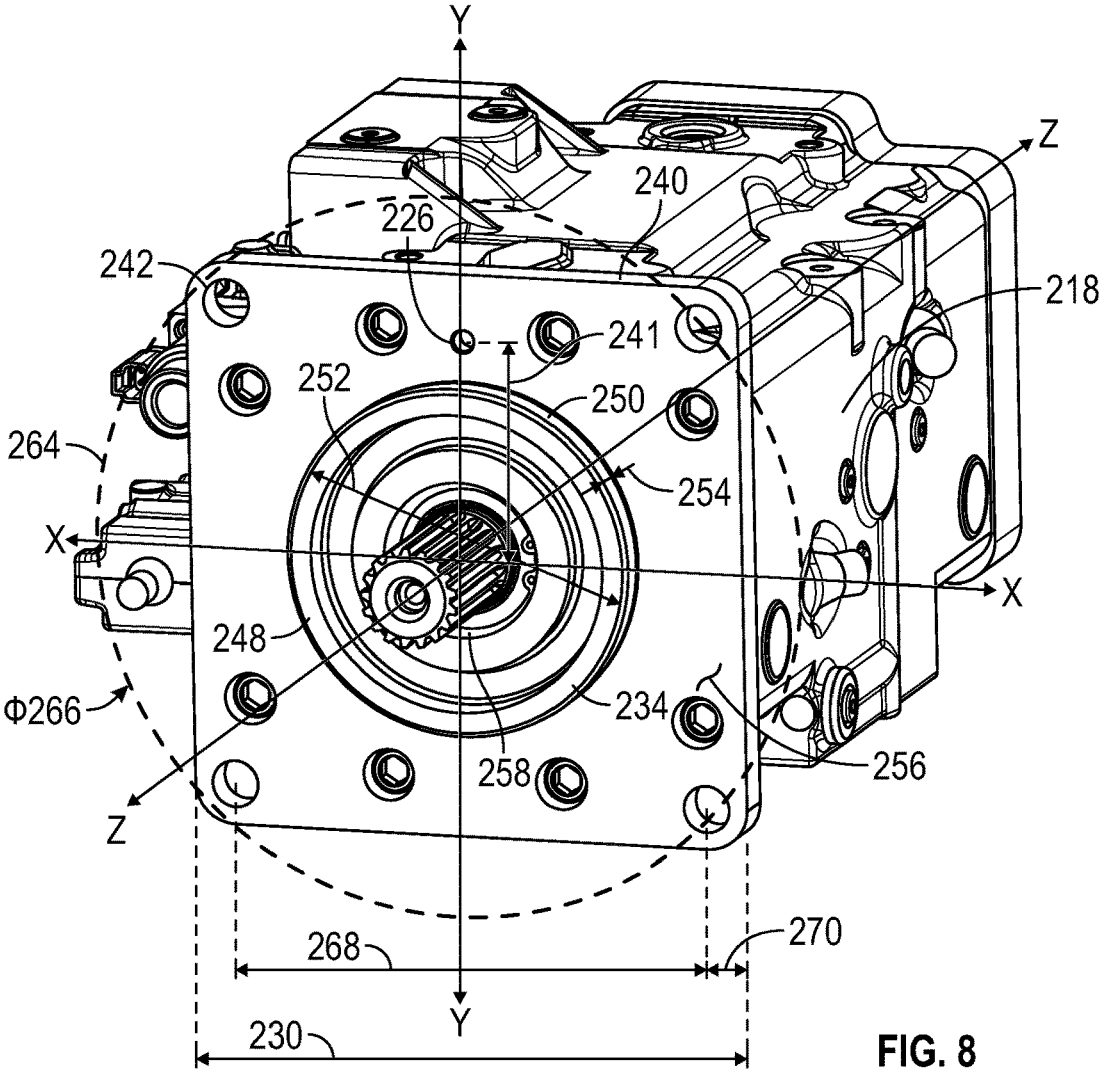
FIG. 8 is a perspective view of another example of a pump or fluid-powered motor with a mounting flange.
Figure 9:
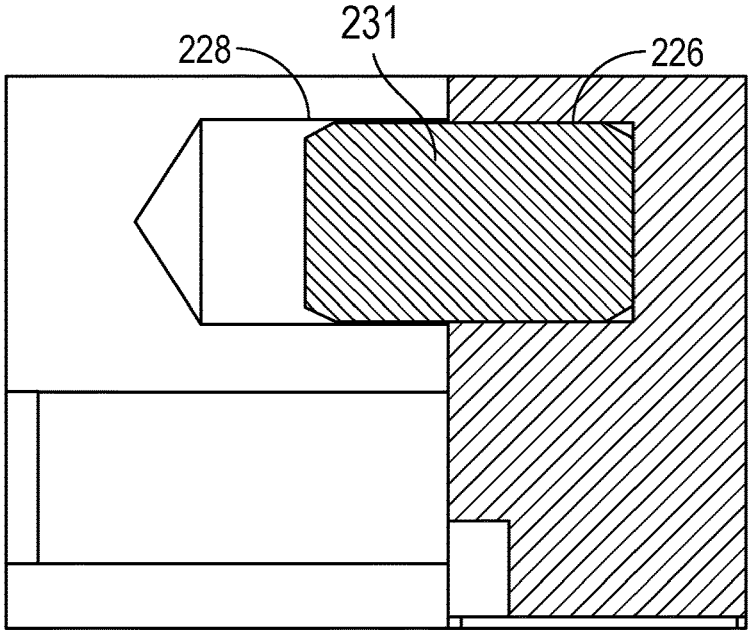
FIG. 9 is a cross-sectional view of a torque pin feature, according to one or more examples.

Turning now to FIGS. 7-9, another example of a flange connection is shown. It is to be appreciated that this pump mounting flange 240 and mounting location 220 is similar to the pump mounting flange 140 and mounting location 120 shown in FIGS. 3-6. Accordingly, unless outlined herein below, the details of the present flange connection are the same as that of the flange connection described with respect to FIGS. 3-6.

While not shown, the mount location 220 may include coupling features for securing the pump 218 to the mount location. The coupling features may be configured to interface with coupling features on the pump 218 to secure the pump to the mount location of the prime mover 104 or other component. In one or more examples, the coupling features may include threaded bores that extend into the housing or other mounting feature of the prime mover or other component. The bores may be adapted to receive bolts that extend through a flange 240 on the pump and into the threaded bores to secure the pump. Alternatively or additionally, the coupling feature may include threaded studs that extend outward from the mount location and may be adapted to engage bolt holes on a flange of a pump where a nut or other fastener may be used to secure the flange to the threaded studs. The threaded bores, the threaded studs, or both, as the case may be, may be arranged in a pattern adapted to match a bolt hole pattern, or a portion thereof, on the flange of the pump.

In one or more examples, a coupling feature in the form of a torque pin feature may be provided to increase the torque carrying capacity of the connection. That is, in contrast to bolts or threaded studs, the torque pin feature may include a torque pin such as a blank or non-threaded pin or dowel arranged in a hole at the mount location where the attachment flange 240 of the pump 218 has a corresponding pin hole and pin or a more permanent protruding pin. In one or more examples, the pin hole at the mounting location 220 may be adapted for more permanently securing the pin or securing the pin ahead of mounting the pump and may be sized for a friction fit or force fit. Alternatively, the pin hole at the mounting location 220 may be adapted to receive the pin during mounting of the pump and, as such, may be sized for a slip fit as compared to a force fit. In still other examples, the pin may protrude from the mounting location and a pin hole may not be provided. In still other examples, a portion of the pin may be threaded to engage a threaded pin hole at the mounting location leaving an exposed portion of the pin which is not threaded. In the case of a pin hole 226 sized for a friction fit or a force fit, a diameter of the pin hole may range from approximately 6 mm to approximately 14 mm or from approximately 8 mm to approximately 12 mm, or a diameter of approximately 9.34 mm may be provided. The pin hole depth at the mounting location may range from approximately 7 mm to approximately 13 mm or from approximately 8 mm to approximately 10 mm or a depth of approximately 9 mm may be provided. The pin hole or pin at the mounting location may be arranged in a position that corresponds to a pin hole or pin on the mounting flange, discussed in more detail below.

As shown in FIG. 7, the coupling feature of the mount location may also include a pilot recess or opening 232 configured to receive a pilot of the pump flange 240 to provide for alignment of the pump 218. The pilot of the pump flange 240 is discussed in more detail below. The pilot recess or opening 232 at the mount location 220 may have a shape matching that of the pilot and slightly larger than the pilot so as to receive the pilot in nested fashion. In one or more examples, the pilot recess or opening 232 may be a circular recess or opening having a diameter slightly larger than the pilot on the pump flange 240. For example, the recess or opening diameter may range from approximately 154 mm to approximately 170 mm or from approximately 160 mm to approximately 162 mm or a diameter of 162.55 mm may be provided. In the case of a recess rather than an opening, the recess may have a depth adapted to fully receive the pilot (e.g., without the pilot bottoming out in the recess). That is, the recess depth may be slightly larger than the stub length of the pilot.

In addition to the pilot recess or opening 232, a seal recess 236 may also be provided at the mount location 220. That is, as shown in FIG. 7, the seal recess 236 may have a diameter larger than the pilot opening or recess 232 and may extend into the face of the mount location 220 with a depth selected to receive a portion of a face seal. In one more examples, the seal recess 236 may have a diameter ranging from approximately 160 mm to approximately 180 mm or from approximately 168 mm to approximately 172 mm, or a diameter of approximately 171.38 mm may be provided. The seal recess may have a depth ranging from approximately 1.5 mm to approximately 4.1 mm or from approximately 2.4 mm to approximately 3.2 mm, or a depth of approximately 2.84 mm may be provided.

The pump 218 may be secured to the mount location 220 and may be powered by the shaft or socket of the mount location 220. That is, as mentioned above, a powered splined socket or shaft may be provided at the mount location 220, which may be engaged with a splined shaft or socket of the pump 218 to provide rotational power to the pump 218. For purposes of securing the pump 218 to the mount location 220 and to manage the torsional and other forces between the pump 218 and the mount location 220, the pump 218 may include an attachment flange 240.

As shown in FIG. 8, the attachment flange 240 of the pump may be a generally rectangular or square flange having a width/length 230 ranging from approximately 245 mm to 285 mm or from approximately 260 mm to 270 mm or a width/length may be approximately 265 mm. As noted, the flange 240 may be rectangular or square and, as such, the width/length 230 might not be the same (e.g., rectangular) or the width/length 230 may be the same (e.g., square). The corners on the flange may be radiused corners having a radius ranging from approximately 16 mm to 22 mm or from approximately 18 mm to 20 mm or a radius of 19 mm may be provided. The flange 140 may have a thickness ranging from approximately 17 mm to 22 mm or from approximately 19 mm to 20 mm, or a thickness of approximately 19.5 mm may be provided.

The flange 240 may include a pilot 234 for engaging a pilot recess or opening 232 at the mount location 220. As shown in FIG. 8, the pilot 234 may include a raised element on the surface of the flange 240 adapted for arrangement in the pilot recess or opening 232 of the mount location 240. The pilot 234 may have a generally cylindrical shape having a circular end face 248 and a cylindrical sidewall 250 defined by a pilot diameter 252 and a stub length 254 extending away from a face 256 of the flange 240. The diameter 252 of the pilot 234 may range from approximately 154 mm to 170 mm, or from approximately 160 mm to approximately 164 mm or the pilot 234 may have a diameter 252 of approximately 162.5 mm. The stub length 254 may range from approximately 14 mm to 18 mm or have a length of approximately 16 mm. The intersection between the cylindrical sidewall 250 and the end face 248 of the pilot 234 may be chamfered. While described as cylindrical, alternatively, the pilot 234 may be rectangular, square, triangular, star-shaped, cross-shaped, or another shape may be provided.

As shown in FIG. 8, the flange 240 may include a through bore 258 arranged within the boundary of the pilot 234 to allow the shaft of the pump 218 to extend out of the pump 218 for engagement with the socket 120 or to allow a shaft of the mount location 220 to extend into the pump 218 to engage a socket. The through bore 258 may have a diameter ranging from approximately 50 mm to 80 mm or approximately 60 mm to 70 mm or a diameter of approximately 66 mm may be provided. A chamfered or notched transition may be provided along the peripheral edge of the through bore 258 to transition from circular face 248 of the pilot 234 to the through bore 258.

In one or more examples, and as shown in FIG. 8, the flange may define an X-Y-Z coordinate system where the Z-axis extends along a centerline of the power providing or receiving shaft. The X-axis may extend laterally across the face of the flange and the Y-axis may extend up/down across the face of the flange. All axes may pass through an origin arranged on the face of the flange along the Z-axis.

As shown, the flange 240 may include a plurality of bolt holes 242 for securing the pump 218 to the mount location 240. The bolt holes 242 may be arranged to align with one or more portions of the coupling feature of the mount location 220. That is, for example, where threaded bores or threaded studs are provided at the mount location 220, the flange 240 may include one or more bolt holes 242 that align with these aspects of the coupling feature. In one or more examples, the plurality of bolt holes 242 may be arranged on a bolt circle 264 having a diameter 266 ranging from approximately 300 mm to approximately 335 mm or from approximately 315 mm to approximately 320 mm, or a bolt circle diameter 266 of 317.49 mm may be provided. It is to be appreciated that with respect to the torsional forces of the pump, the arrangement of the several bolt holes 242 on a same bolt circle 264 may cause all of the bolts arranged in the bolt holes 242 to experience a generally equally divided amount of load from the torsional force. That is, where 4 bolts are provided, each bolt may experience ¼ of the torsional load. Loads that vary from this equally divided condition may also be carried by the bolts.

As shown, bolt holes 242 for receiving bolts to secure the pump may be arranged in a rectangular or square pattern. In one example, the rectangular or square bolt patter may include a 4-bolt pattern. These bolt holes may be configured for securing a pump to a mount location with a corresponding pattern of threaded bores. That is, the flange bolt hole positions may correspond with the bore positions at the mount location. In one or more examples, the pattern may be a square pattern where the bolt spacing 268 from one bolt hole 242 to an adjacent bolt hole 242 ranges from approximately 214 mm to approximately 234 mm or from approximately 220 mm to approximately 228 mm or a spacing of approximately 224.5 mm may be provided.

The bolt holes 242 may have a diameter or width adapted to receive a bolt sufficiently large to carry the torsional and other loading. In one or more examples, the bolt holes 242 may have a diameter adapted for receiving an M20 bolt. The bolt holes 242 may be spaced inward from an outer edge of the flange by an edge distance 270 of approximately 19 mm. In one or more examples, for purposes of installation, the bolt hole 242 may extend through an outer edge of the flange 240. That is, for example, a slot may extend from the bolt hole 242 through the edge of the flange 240. In one or more examples, the bolt holes 242 may be arranged generally in the corners of the flange 240 and the slot may be arranged diagonally to extend from the bolt hole 242 through the corner of the flange 240. The slot may have a width that is the same as the bolt hole diameter. In one or more examples, the bolt hole diameter and/or slot width may range from approximately 18 mm to approximately 26 mm or from approximately 20 mm to approximately 24 mm or a bolt hole diameter and/or slot width of approximately 22 mm may be provided. While slots extending diagonally through the corners of the flange have been described, horizontal or vertical slots may also be provided.

The pump 218 may be mounted to the mount location 220 with bolts, studs, or other fasteners. In one or more examples, a bolt size of M20 may be provided. Still other bolt sizes may be provided.

As mentioned with respect to the mount location, the flange may also include a torque pin feature such as a torque pin 231 or hole 228 for receiving the torque pin. The torque pin may be a blank or non-threaded pin or dowel arranged in a hole on the flange in a position corresponding with the location of the pin hole at the mount location. In one example, the flange may be adapted to receive the pin during mounting of the pump and, as such, may be sized for a slip fit as compared to a force fit. Alternatively, the pin hole on the mounting flange may be adapted for more permanently securing the pin or securing the pin ahead of mounting the pump and may be sized for a friction fit or force fit. In still other examples, the pin may protrude from the flange and a pin hole may not be provided. In still other examples, a portion of the pin may be threaded to engage a threaded pin hole on the flange leaving an exposed portion of the pin which is not threaded. In the case of a pin hole sized for a slip fit, a diameter of the pin hole may range from approximately 6 mm to approximately 14 mm or from approximately 8 mm to approximately 12 mm, or a diameter of approximately 10 mm may be provided. The pin hole depth at the mounting location may range from approximately 6 mm to approximately 14 mm or from approximately 11 mm to approximately 13 mm or a depth of approximately 12 mm may be provided.

The pin hole or pin on the mounting flange may be arranged within a rectangular or square boundary defined by the one or more bolt holes arranged on the flange. For example, as shown in FIG. 8, the pin hole or pin may be arranged on the Y-axis and may be spaced from the X-axis a distance 241 less than the upper set of bolt holes. In one or more examples, the pin hole or pin may be arranged on the Y-axis and the distance 241 from the X-axis may range from approximately 90 mm to 110 mm, or from approximately 95 mm to approximately 105 mm, or a distance of approximately 100 mm may be provided. In some examples, the pin hole or pin may be arranged on the bolt circle defined by the 4-bolt pattern defined by the bores or bolt holes in the mounting location and/or the pump flange, respectively. Moreover, while the pin hole or pin has been shown to be above the X-axis, a pin hole or pin may, instead, be provided below the X-axis. The pin hole or pin may also be arranged outside the rectangular or square boundary rather than within the rectangular or square boundary. It is to be appreciated that when the pin hole or pin is arranged within the boundary, care may be taken to avoid interference with the face seal surrounding the pilot area. Still further, while the pin hole or pin has been shown to be arranged on the Y-axis, the pin hole or pin may be arranged on the X-axis or it may be arranged off of the axes. While a single pin hole or pin has been shown or described, multiple pin holes or pins may be provided such as 2, 3, 4, 5, 6, 7, 8, or more pin holes or pins. In some examples, a combination of pin holes and pins may be provided on the flange with corresponding pins and pin holes being provided at the mounting location. Still other approaches to locating the pin hole or pin may be provided.

It is to be appreciated that while a mount location such as on an engine and a flange on a pump have been described, the pump or fluid-powered motor may be coupled to another pump or another pump may be coupled to it.

Accordingly, while the pump has been described as having an attachment flange, the pump or fluid-powered motor may also include a mount location on an opposite end for attachment of another pump.

INDUSTRIAL APPLICABILITY

Several advantages of the above-described design give rise to its industrial applicability. For example, the particular sizes and spacings of the several components making up the connection between the pump and the mount location may provide for a strong, torque resisting connection not provided by standard designs. The particular sizes and relationships between the sizes may provide for a connection and torque resistance suitable for a wide range of connections and, in particular, pump connections such as axial piston pump, gear pump, or other pump connections. In one or more examples, the present connection design may be suitable for pumps having torques ranging from approximately 300 Nm to approximately 1500 Nm or from approximately 600 Nm to approximately 1200 Nm, or a torque of approximately 650 Nm or approximately 1130 Nm may be provided. In one or more examples, the connection design of FIGS. 3-6 may be suitable for pumps having a torque of approximately 1130 Nm while the connection design of FIGS. 7-9 may be suitable for pumps having a torque of approximately 650 Nm. These connection designs may be suitable for pumps providing flow capacities ranging from approximately 200 L/min to approximately 800 L/min or from approximately 300 L/min to approximately 600 L/min or approximately 370 L/min or approximately 550 L/min. For example, the connection design of FIGS. 3-6 may be suitable for pumps having flow capacities of approximately 370 L/min while the connection design of FIGS. 7-9 may be suitable for pumps having flow capacities of approximately 550 L/min.

In both of the examples discussed in the present application, the flange/mount locations include a torque pin feature. The torque pin feature provides an additional level of torque resistance without changing the flange shape to, for example, accommodate an additional bolt or bolts. Moreover, the torque pin feature is located in an area where, for example, the back side of the flange may not be accessible to install a nut, for example. In some examples, the torque pin feature is positioned far enough from the axis origin that it provides for a reasonable amount of torque resistance. In particular, the ratio of the distance of the torque pin feature from the origin to the pilot diameter ranges from approximately 0.5 to approximately 1 or from approximately 0.5 to approximately 0.8, or from approximately 0.5 to approximately 0.7 or a ratio of approximately 0.6 or approximately 0.61 may be provided. The lower limit of 0.5 maintains the torque pin feature outward of the pilot. However, torque pin features may also be provided within the pilot. It is noted and those of skill will appreciate that the further the torque pin feature is from the origin, the more torque resistance it may provide.

The ratios of the bolt spacings to the pilot diameter may also be unique, resulting from reductions in the pilot diameter to accommodate the torque pin feature. In one or more examples, the ratio of the bolt spacing to the pilot diameter may range from approximately 1.0 to approximately 1.16, or from approximately 1.06 to approximately 1.10, or a ratio of approximately 1.08 may be provided. In another example, the ratio of the bolt spacing to the pilot diameter may range from approximately 1.30 to approximately 1.50, or from approximately 1.36 to approximately 1.40, or a ratio of approximately 1.38 may be provided.

In another example, the ratio of the bolt circle to the pilot diameter may establish a unique value that accommodates pump size, sealing requirements, bolt spacing and edge distances, and torque loading requirements. In one or more examples, the ratio of the bolt circle diameter to the pilot diameter may range from approximately 1.4 to 1.64 or from approximately 1.48 to 1.56 or a ratio of 1.52 may be provided. In another example, the ratio of the bolt circle diameter to the pilot diameter may range from approximately 1.80 to approximately 2.10 or from approximately 1.90 to approximately 2.00, or a ratio of approximately 1.95 may be provided.

The above detailed description is intended to be illustrative, and not restrictive. The scope of the disclosure should, therefore, be determined with references to the appended claims, along with the full scope of equivalents to which such claims are entitled.

What is claimed is:

1. A pump or fluid-powered motor and a flange for securing the pump or fluid-powered motor to a mount location, the pump or fluid-powered motor and flange comprising:

a pump housing defining an inlet and an outlet;

internal pump components arranged within the housing and operably coupled to a drive shaft extending out of an end of the housing and defining a longitudinal axis; and a pump flange arranged on the end of the housing and comprising a generally rectangular plate having a plurality of bolt holes, a pilot projection defining a pilot diameter, a torque pin feature, and a through bore with the drive shaft extending therethrough, the pump flange being arranged in an X-Y plane orthogonal to the longitudinal axis and the plurality of bolt holes defining a rectangular pattern with an X-spacing and a Y-spacing, and the torque pin feature being arranged a distance from the longitudinal axis and on the Y-axis, wherein a ratio of the distance to the pilot diameter ranges from approximately 0.50 to approximately 0.70.

2. The pump or fluid-powered motor and flange of claim 1, wherein the rectangular pattern is a square pattern.

3. The pump or fluid-powered motor and flange of claim 2, wherein the X-spacing is approximately 162 mm.

4. The pump or fluid-powered motor and flange of claim 1, wherein the torque pin feature comprises a pin hole with a pin arranged in the pin hole with a force fit.

5. The pump or fluid-powered motor and flange of claim 4, wherein the pin comprises a diameter of approximately 9.4 mm.

6. The pump or fluid-powered motor and flange of claim 1, wherein each of the plurality of bolt holes comprise a crossing dimension of approximately 22 mm.

7. The pump or fluid-powered motor and flange of claim 6, wherein the bolt holes are circular and the crossing dimension is a hole diameter.

8. The pump or fluid-powered motor and flange of claim 6, wherein the bolt holes are slots and the crossing dimension is a slot width.

9. The pump or fluid-powered motor and flange of claim 8, wherein the slots are diagonal slots that extend through an edge of the generally rectangular plate.

10. The pump or fluid-powered motor and flange of claim 1, wherein the torque pin feature is above the drive shaft.

11. The pump or fluid-powered motor and flange of claim 1, wherein the torque pin feature is below the drive shaft.

12. The pump or fluid-powered motor and flange of claim 1, wherein a ratio of the pilot diameter to the X-spacing is less than 0.93.

13. The pump or fluid-powered motor and flange of claim 12, wherein a ratio of the pilot diameter to the X-spacing is approximately 0.928.

14. The pump or fluid-powered motor and flange of claim 1, wherein the ratio of the distance to the pilot diameter range from approximately 0.59 to approximately 0.62.

15. A connection for a pump or fluid-powered motor, comprising:

a mount location defining an X-Y plane and comprising a plurality of threaded bores for receiving fasteners, a pilot recess or opening, a portion of a rotational power coupling defining a longitudinal axis, and a first torque pin feature, the plurality of threaded bores being arranged in a first rectangular pattern with an X-spacing and a Y-spacing and the torque pin feature being arranged a first distance from the longitudinal axis on the Y-axis, wherein a ratio of the first distance to the pilot diameter ranges from approximately 0.50 to approximately 0.70; and a flange configured for securing to the mount location, the flange comprising a generally rectangular plate having a plurality of bolt holes, a pilot projection defining a pilot diameter and configured for nested engagement with the pilot recess or opening, a second torque pin feature, and a through bore with a drive shaft extending therethrough, the plurality of bolt holes arranged in a second rectangular pattern corresponding with the first rectangular pattern, and the second torque pin feature being arranged along the Y-axis a second distance corresponding to the first distance.

16. The connection of claim 15, wherein the first torque pin feature comprises a first pin hole configured for a slip fit with a torque pin.

17. The connection of claim 16, wherein the second torque pin feature comprises a second pin hole configured for a force fit with the torque pin.

18. The connection of claim 17, further comprising the torque pin arranged in the second pin hole.

19. The connection of claim 15, wherein the second torque pin feature comprises a pin extending from the generally rectangular plate and generally parallel to the longitudinal axis.

20. The connection of claim 15, wherein the plurality of threaded bores comprises 4 threaded bores.

* * * * *